US011345500B1

(12) United States Patent
Kalm et al.

(10) Patent No.: US 11,345,500 B1
(45) Date of Patent: May 31, 2022

(54) BAG LOADING MACHINE AND METHOD OF PACKAGING ITEMS

(71) Applicant: Amazon Technologies, Inc., Seattle, WA (US)

(72) Inventors: William Scott Kalm, Seattle, WA (US); Kushal Patel, Seattle, WA (US)

(73) Assignee: Amazon Technologies, Inc., Seattle, WA (US)

( * ) Notice: Subject to any disclaimer, the term of this patent is extended or adjusted under 35 U.S.C. 154(b) by 124 days.

(21) Appl. No.: 16/709,836

(22) Filed: Dec. 10, 2019

(51) Int. Cl.

| | |
|---|---|
| ***B65B 43/46*** | (2006.01) |
| ***B65B 43/44*** | (2006.01) |
| ***B65B 43/28*** | (2006.01) |
| ***B65B 43/36*** | (2006.01) |
| ***B65B 51/14*** | (2006.01) |
| ***B65B 43/18*** | (2006.01) |
| ***B65B 43/30*** | (2006.01) |
| ***B65B 5/06*** | (2006.01) |

(52) U.S. Cl.
CPC ..... *B65B 43/465* (2013.01); *B65B 5/067* (2013.01); *B65B 43/18* (2013.01); *B65B 43/28* (2013.01); *B65B 43/30* (2013.01); *B65B 43/36* (2013.01); *B65B 43/44* (2013.01); *B65B 51/146* (2013.01)

(58) Field of Classification Search
CPC ..... B65B 5/067; B65B 43/14; B65B 43/16; B65B 43/18; B65B 43/28; B65B 43/30; B65B 43/36; B65B 43/44; B65B 43/465; B65B 43/54; B65B 43/56; B65B 51/146
USPC .... 53/459, 469, 570, 571, 573, 284.7, 385.1
See application file for complete search history.

(56) References Cited

U.S. PATENT DOCUMENTS

| | | | | | |
|---|---|---|---|---|---|
| 3,698,451 | A * | 10/1972 | Hudson | B65B 43/30 | 53/571 |
| 4,037,387 | A * | 7/1977 | Orikawa | B65B 43/12 | 53/459 |
| 4,174,599 | A * | 11/1979 | Callet et al. | B65B 43/30 | 53/570 |
| 4,914,895 | A * | 4/1990 | Kuckhermann et al. | B65B 43/465 | 53/571 |
| 2004/0238128 | A1* | 12/2004 | Giro Amigo | B65B 43/465 | 53/570 |
| 2010/0206424 | A1* | 8/2010 | Gustafsson | B65B 5/067 | 141/1 |

FOREIGN PATENT DOCUMENTS

| | | | | |
|---|---|---|---|---|
| EP | 0844175 | A1 * | 5/1998 | B65B 43/465 |
| FR | 3030460 | A1 * | 6/2016 | B65B 43/465 |
| JP | 05147621 | A * | 6/1993 | |
| WO | WO-2014191152 | A1 * | 12/2014 | B65B 43/465 |

* cited by examiner

*Primary Examiner* — Stephen F. Gerrity
(74) *Attorney, Agent, or Firm* — Kilpatrick Townsend & Stockton LLP

(57) ABSTRACT

An item packaging system can position and prepare a package for receiving one or more items. The package can be received by the system in a storage orientation and stored in a storage container. A picking assembly can be positioned above the storage container in a picking orientation and pick and rotate the package to a loading orientation. A gripper can grip the package in the loading orientation and transport the package to a loading station for loading the one or more items into the interior of the shipping receptacle.

16 Claims, 8 Drawing Sheets

BAG LOADING MACHINE AND METHOD OF PACKAGING ITEMS

BACKGROUND

Packing for shipping an item may depend on the item type, the shipping route, the delivery location, and other similar factors. Packaging can be manufactured ahead of time or built on demand. Packaging can vary from simple envelopes for one or more items to more complex customized pallets for shipping larger or oddly shaped items. For example, a few items may be packaged into a pre-manufactured paper bag before being delivered.

BRIEF DESCRIPTION OF THE DRAWINGS

Various embodiments in accordance with the present disclosure will be described with reference to the drawings, in which.

DETAILED DESCRIPTION

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

Examples herein are directed to a packaging system for orienting a package (such as a paper bag), preparing and positioning the package for receiving items, and sealing the package. Specifically, features herein are directed to a picker, grippers, and associated components that may facilitate the positioning of items in the packaging and movement of the packaging between elements of the inventory system. The picker may be controlled to attach to and orient the packaging in manners particularly suited for facilitating the loading of the packaging with items. The grippers may be controlled to grasp, move, and release the packaging in manners particularly suited for moving the package between a filling and sealing stations.

Figure 1:
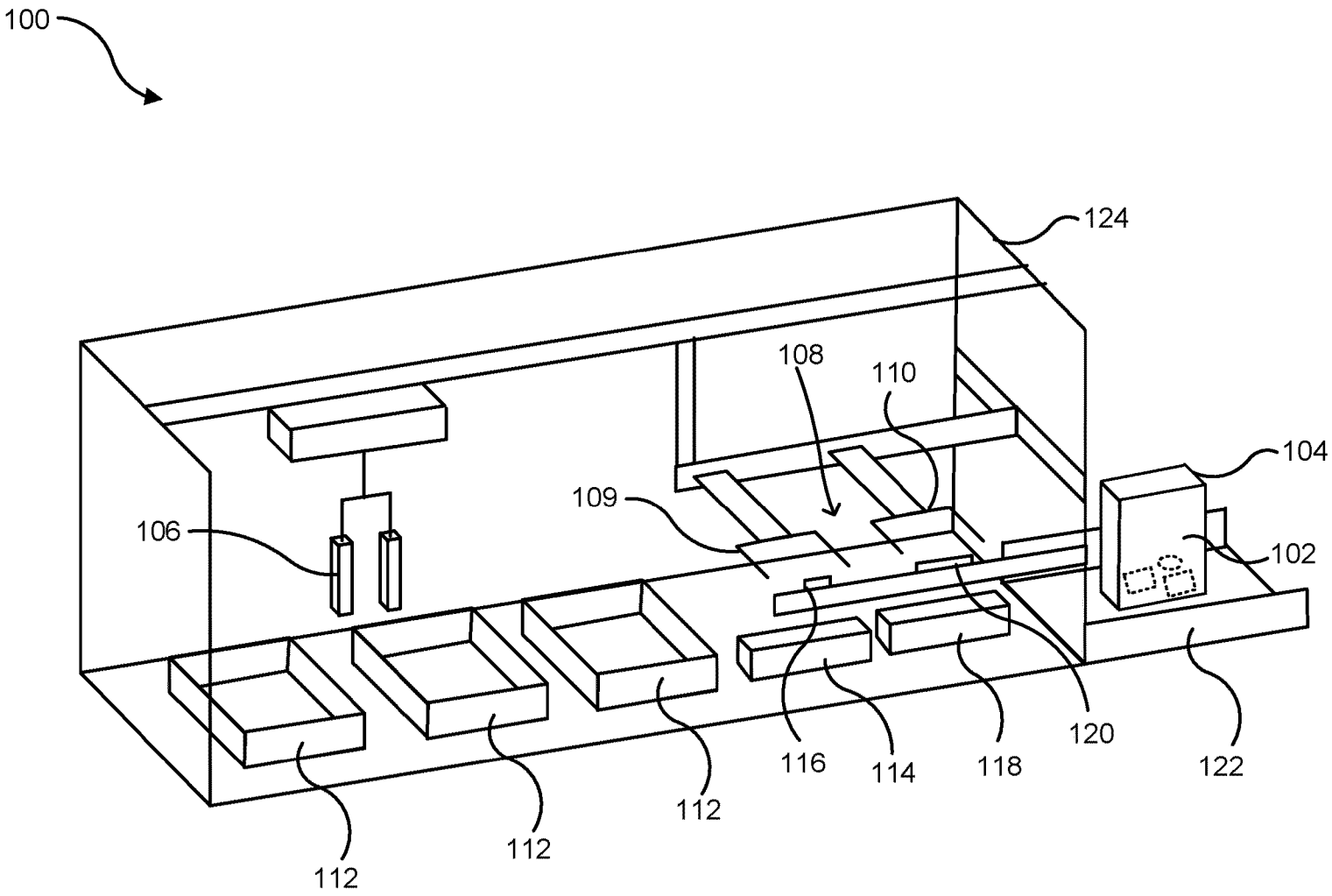
FIG. 1 illustrates an item packaging system, in accordance with embodiments, for packaging items.

Referring now to the drawings in which like-referenced numerals and/or names may refer to like elements, FIG. 1 illustrates an item packaging system 100 for packaging one or more items 102 in a package 104. The inventory system 100 can include a picker 106 and a gripper assembly 108 for orienting and moving the package 104.

The picker 106 can pick a package 104 in a storage orientation from one or more storage containers 112. The picker 106 can reorient the package 104 from the storage orientation to a loading orientation and transport the package to a position for gripping by the gripper assembly 108. At the outset, the gripper assembly 108 (e.g., via a first gripper 109) can grip the package 104 and transport the package to a loading station 114 for loading the items 102 into the package. In various embodiments, the loading station 114 can include one or more loading components 116 for opening and preparing the package for receiving items 102. The items 102 can be loaded into the package 104 and the gripper assembly 108 (e.g., via a second gripper 110) can re-grip the package 104 and transport the package from the loading station 114 to the sealing station 118 for sealing the items 102 in the package. In some embodiments, the sealing station 118 can include a sealing device 120 to seal the package 104 with the items 102 inside. The gripper assembly 108 (e.g., via the second gripper 110) can grip the sealed package 104 and transport the sealed package to an output station 122. The output station 122 can include a suitable receptacle, conveyor, or other structure suitable for facilitating transport the of package 104 for further processing.

In many embodiments, one or more components of the item packing system 100 can be mounted to a support frame 124 positionable in a warehouse environment. For example, respective parts or components of the storage container 112, the picker 106, the gripper assembly 108 (e.g., the first gripper 109 and the second gripper 110), the loading station 114, the sealing station 118, and/or the output station 122 can be mounted to the support frame 124 at least in part individually or in various combinations. In some embodiments, one or more of the components of the item packing system 100 can be drivingly mounted to move between various positions on the support frame 124. For example, the picker 106 can move to pick one or more packages 104 from the storage containers and transport the packages to the gripper assembly 108.

Items 102 can be goods or inventory stored in a warehouse environment and purchasable by a purchaser. In various embodiments, the items 102 may be ordered by a purchaser through an online portal. For example, the items 102 may be or include a plastic action figure, a dog toy, or a watch purchased through the online portal. The item 102 can be retrieved from the warehouse environment, transported to the loading station 114, and deposited into the package 104 so that the package can be completed and sent (or otherwise transported) to the purchaser for delivery of the item in fulfillment of the purchase.

The package 104 can be a package or shipping receptacle used for packing items 102 prior to shipping. The package 104 can include one or more surfaces surrounding an interior volume. In many embodiments, the package 104 can be a bag with one end open for receiving the items 102. For example, the package 104 can be a foldable paper bag with an open top. The package 104 can be configured in a storage orientation or a loading configuration. In the storage orientation, the package 104 can be in a folded and/or flattened state to reduce the interior volume of the package and making the package easier to store (e.g., making multiple packages easier to stack together). For example, a package 104 can be in a flattened state stacked with additional packages to form a stack of flattened packages that can be more easily transported and loaded into the item packaging system 100. In the loading configuration, the package 104 can be separated or expanded to receive the items 102. The package 104 can be or include paper, cardboard, corrugated materials, or materials suitable for receiving items 102 without breaking. The package 104 may include sealing material to aid in sealing the package.

Multiple packages 104 may be stacked in the storage orientation in the storage containers 112 such that multiple packages 104 are stacked in a single storage container 112. For example, this may correspond to a stack of folded paper bags that may each occupy a smaller amount of space than if unfolded or opened to form a receiving volume. The storage container 112 can be or include, for example, a metal bin or other container for receiving multiple packages.

The picker 106 can be or include components for grabbing or manipulating the packages 104. The picker 106 can be drivingly mounted to the support frame 124 to move along the support frame. For example, the picker 106 can move to one or more positions for picking the packages 104 and one or more positions for transferring the packages to the grabbing assembly. Additionally or alternatively, the components of the picker 106 can be driven and/or actuated to pick and rotate the package 104. The picker 106 can rotate between first and second orientations for picking and orienting the packages 104. For example, the picker 106 can rotate between first and second orientations. In the first orientation, the picker 106 can be oriented to pick the packages 104 from the storage containers 112. The picker 106 can attach to and lift (i.e., pick) the package 104 in the storage orientation and rotate. The picker 106 can rotate to the transport orientation, which rotates the attached package 104 to the filling orientation. In embodiments, the rotation of the picker 106 attached to the package 104 may correspond to a folded paper bag being re-oriented from a laying down alignment to an upright alignment that may facilitate subsequent opening of the bag. The picker 106 (e.g., by driving movement along the support frame 124) can transport the package 104 to a position for grabbing by the gripper assembly 108. In some embodiments, the picker 106 can reorient the package 104 prior to transporting the package to the gripper assembly 108. However, the picker 106 may reorient the package 104 at the same time or after the picker transports the package to the gripper assembly 108.

The gripper assembly 108 can grip the package 104 from the picker 106. The package 104 can be grabbed in the loading orientation and transported by the gripper assembly 108 to the loading station 114. The gripper assembly 108 can be or include components for grabbing, moving, or manipulating packages individually or in combination. For example, the gripper assembly 108 can be or include two opposing surfaces that can close and open to respectively grip and drop the package 104. The gripper assembly 108 can include one or more grippers capable of moving the package 104 relative to other elements of the item packaging system 100. For example, a first gripper 109 and a second gripper 110 are depicted in FIG. 1, although one, two, or other number of grippers could be utilized. The first gripper 109 can grip the package 104 from the picker 106 and transport the package 104 to a loading station 114. The second gripper 110 can grip the package 104 at the loading station 114 and transport the package to a sealing station 118.

The loading station 114 can be or include a platform for receiving the package 104 in the loading orientation. In some embodiments, the loading station 114 can include one or more loading components 116 for separating two opposing sides of the package 104 and preparing the package for receiving items 102.

The sealing station 118 can seal the package 104 with the items 102 contained inside for further processing. The sealing station 118 can be or include a platform for supporting the package 104 filled with items 102. "Filled" may refer to a volume at least partially occupied and need not be limited to only arrangements in which a volume is entirely occupied. In some embodiments, the sealing station 118 can include one or more sealing devices 120 for aiding the sealing of items 102 in the package 104. The sealing devices 120 can be or include a glue applicator, a staple gun, a tape application, or a similar device for sealing packages.

In many embodiments, the sealed package 104 can be transported to an output station 122 for further processing of the packaged items 102. For example, the sealed package 104 can be transported for shipping out of the warehouse environment. The output station 122 can be or include motor driven roller, belted rollers, or components suitable for moving the sealed package 104 or containing the sealed package 104 during movement.

Figure 2:
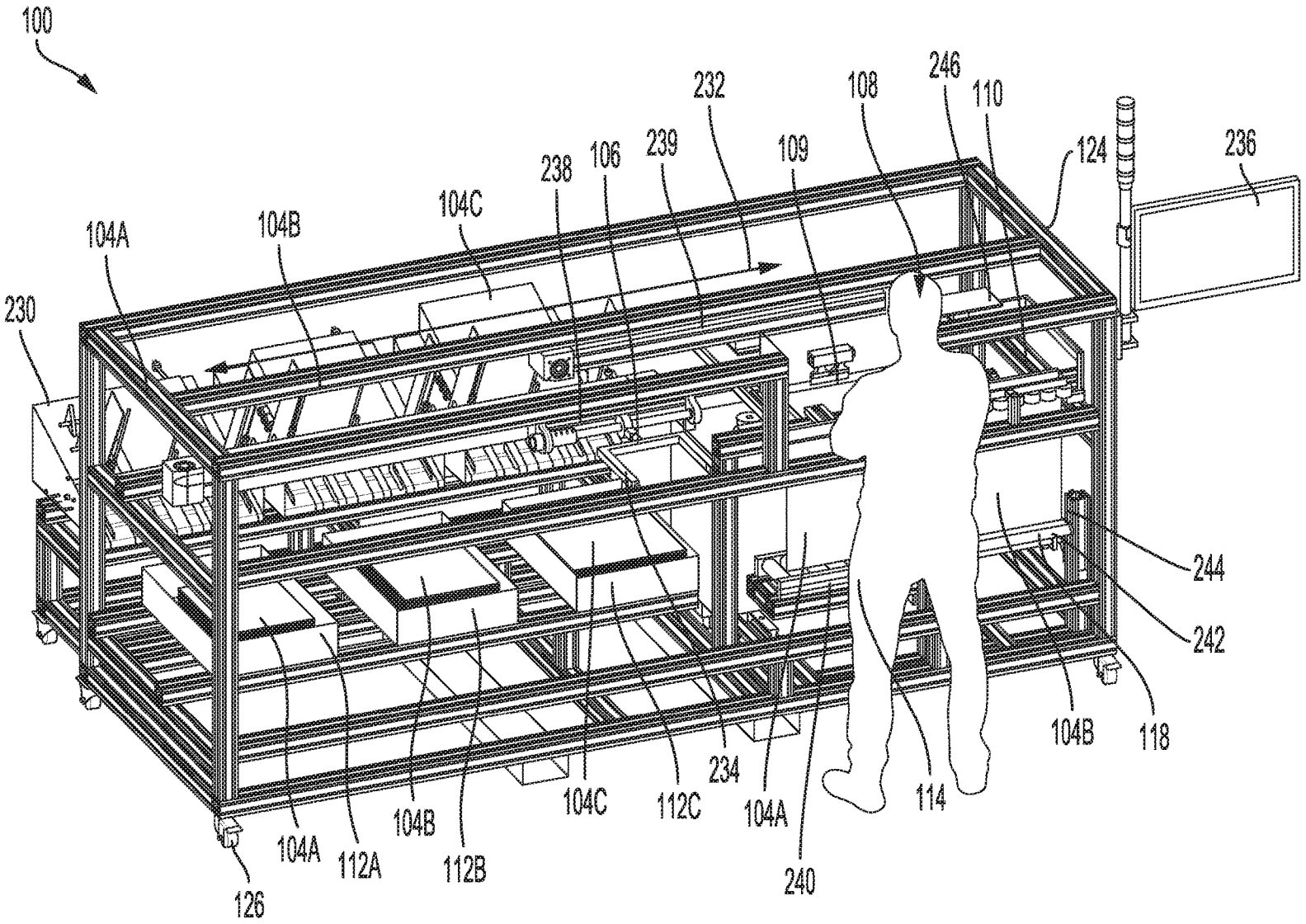
FIG. 2 illustrates an example of the item packaging system of FIG. 1, according to particular embodiments.

FIG. 2 is an example item packaging system 100 for preparing one or more packages 104 for receiving items 102. The item packaging system 100 can include a picker 106, a gripper assembly 108, a loading station 114 and a sealing station 118. The item packaging system 100 can move and orient the package 104, position the package for loading with items 102, and seal the package.

One or more of the components of the item packaging system 100 can be mounted to a support frame 124. The support frame 124 can include mounting points for mounting components of the item packaging system 100. The support frame 124 can be or include a metal frame connected by fasteners. The support frame 124 may be or include material strong enough to support the components of the item packaging system 100.

In many embodiments, the support frame 124 can be moveable to reposition the support frame 124 around a warehouse environment. The support frame 124 may include wheels 126 or similar movement components for aiding movement of the support frame within the warehouse environment. The support frame 124 can be manually moved around the warehouse environment. However, the support frame 124 may be moved around the warehouse with an automated process. For example, the wheels 126 may be drivingly connected to motors or the support frame 124 may be connected with a device for moving the support frame around the warehouse environment.

The packages 104 for use with the item packaging system 100 can receive one or more items 102. The packages 104 can be sized and shaped for receiving one or more items 102 of various sizes and shapes. For example, the packages 104 can be a rectangular shape with height, width, and length dimensions. As an illustrative example, the packages 104 may have a height between 12" and 24", a width between 3" and 10", and a length between 6" and 18". Thus, packages 104 may have interior volumes between 200 cubic inches and 5000 cubic inches. The packages 104 can be oriented in a storage orientation and a loading orientation. For example, in the storage orientation the package 104 may have a width less than the width of the package in the loading orientation. In a non-limiting example, the package 104 has a storage orientation with a width less than 0.5" (and an open side facing the front of the support frame 124), yet have a loading configuration with a width greater than 3" (and the open side facing up toward a top of the support frame). In many embodiments, packages 104 with different dimensions can be used with the item packing system 100. For example, a first package 104A with first dimensions can be used in the same system as a second package 104B with second dimensions and a third package 104C with third dimensions. In some embodiments, two or more of the packages 104A, 104B, 104C may have the same or similar dimensions. For example, 104A and 104C may have first dimensions and 104B may have second dimensions.

The packages 104 can be flat-bottom bags with one open face for receiving items 102. In the loading orientation, the flat-bottom bag can be capable of standing on its own to receive the items 102 through the open top. The flat-bottom bag can have a generally planar bottom surface and sidewalls extending from the bottom surface. In some embodiments, the packages 104 may be or include pillowed bags, gusseted bags, pouch bags, padded pouches, or any suitable type of bag or pouch.

In some embodiments, the bottom of the package 104 can be curved, wedge shaped, or similarly non-flat. A support surface of platform 240 can be appropriately shaped to support the non-flat bottom of the package 104. For example, the bottom of the package 104 can have a wedge shape and the support surface of the platform 240 can have a V-shape for engaging with and supporting the package.

In many embodiments, the item packaging system 100 can include a package feeder 230 for feeding packages 104 into one or more package containers 112A, 112B, or 112C. The package feeder 230 can include one or more positions for receiving packages 104. The packages 104 can be placed on the package feeder 230 in the storage orientation. In many embodiments, the packages 104 can be stacked on the package feeder 230 to feed multiple packages to the package containers 112A, 112B, or 112C before needing to be refilled with packages. For example, the package feeder 230 can include one or more features allowing a stack of packages 104 to be placed on the feeder and can allow additional packages 104 to be added. In some embodiments, the package feeder 230 can automatically feed packages 104 to the package containers 112A, 112B, or 112C. However, the package feeder 230 may be a manual feeder.

In further embodiments, the package containers 112A, 112B, 112C can be fed with packages 104 directly. Feeding the packages 104 directly into containers 112A, 112B, 112C can prevent the system from running out packages. Additionally or alternatively, the package containers 112A, 112B, 112C can act as buffer stock for the package feeder 230. For example, the package containers 112A, 112B, 112C can be sized and shaped to hold enough packages 104 that the package feeder can run out of and be refilled with packages without needing to stop the system.

In various embodiments, the package feeder 230 can include different positions for receiving packages 104 with different dimensions. For example, the package feeder 230 can include a first position for receiving one or more packages 104A with first dimensions and a second position for receiving one or more packages 104B with second dimensions. Each of the positions may receive packages 104A with first dimensions and packages 104B with second dimensions, at the same time. For example, the bottom half of a stack of packages may be packages 104A with first dimensions and the top half of the stack of packages may be packages 104B with second dimensions. In some embodiments, the package feeder 230 can include positions that can be reconfigured to receive packages of different sizes. For example, a first stack of packages 104A with first dimensions can be placed at a first position. The first position can be reconfigured and a second stack of packages 104B with second dimensions can be placed at the first position.

One or more package containers 112 can receive the packages 104 from the package feeder 230. However, the package containers 112 may receive packages 104 directly. For example, packages 104 may be manually or automatically fed into package containers 112. The package containers 112 can sized and shaped for receiving the packages 104. The package container 112 can be or include a box sized and shaped for receiving a package 104 with particular dimensions. For example, a first package container 112A can be sized and shaped to receive package 104A with first dimensions. In some embodiments, a first package container 112A may receive the packages 104A in addition to packages 104B with second dimensions and/or packages 104C third dimensions. However, in some embodiments, the package containers 112 may receive only one size of package 104. For example, a first package container 112A may only be able to receive packages 104A with first dimensions. In some embodiments, the package container 112 can be or include a metal box with a base and sidewalls. However, the package container 112 may be or include cardboard, plastic, corrugated material, or a container suitable for receiving one or more packages 104.

In many embodiments, the package containers 112 may be repositioned in the item system 100. The package containers 112 can be repositioned to correspond to packages 104 received from the package feeder 230. For example, the package feeder 230 can include three stacks of different sized packages (e.g., 104A, 104B, and 104C, which may correspond to small, medium, and large sizes, for example). Each of the stacks of packages 104A, 104B, 104C can be fed into a package container 112 sized and shaped for receiving the packages (e.g., 112A, 112B, and 112C). Thus, the stack of packages 104A is fed into package container 112A, the stack of packages 104B is fed into package container 112B, and the stack of packages 104C is fed into package container 112C. The order (e.g., going left to right) of the stacks of packages 104A, 104B, and 104C can be changed in the package feeder 230 and the package containers 112A, 112B, and 112C can be changed to correspond to the rearranged stacks.

The picker 106 can pick one or more of the packages 104 from a package container 112, reorient the package from the storage orientation to the loading orientation, and transport the package to a position for gripping by the gripper 108. The picker 106 can include one or more attachment components for attaching to the package 104. For example, the picker 106 can have suction cups that can be pressed against the package 104 to stick to the package. The picker can include one or more arms 234 for attaching to a package 104. The picker 106 can be drivingly mounted to the support frame 124 and can move along axis 232. For example, the picker 106 can move from a position above a package container 112 to a position adjacent to the gripper 108. The picker 106 can be moved along axis 232 by a positioner 238. The positioner 238 can move the picker 106 along axis 232 and position the picker at various points along axis 232 (e.g., above the storage containers 112 or adjacent to the gripper 108). The positioner 238 can be or include a motor, actuator, pneumatic ram, or similar component for moving the picker 106.

In many embodiments, the picker 106 can rotate between a first orientation (e.g., a picking orientation) and a second orientation (e.g., a transport orientation) to reorient the package 104 from a storage orientation to a loading orientation. The picker 106 can be attached to a hinge joint or pivot joint for rotating between the first orientation and the second orientation. Additionally or alternatively, the picker 106 can be driven by a motor or actuator. For example, the picker 106 may be attached to the support frame 124 via a hinge joint or a pivot joint and rotated using a motor. In the first orientation, the picker arms 234 can be oriented generally perpendicular to the ground and in the second orientation, the picker arms 234 can be oriented generally parallel with the ground. As an illustrative example, the picker 106 can move along axis 232 in the transport orientation until the picker is positioned above a package container 112. The picker 106 can rotate from the transport orientation to the picking orientation and attach to a package 104 in a storage orientation positioned in the package container 112. The picker 106 can rotate from the picking orientation to the transport orientation, reorienting the package 104 from the storage orientation to a loading orientation. The picker 106 can transport the package 104 to a position for gripping by the gripper assembly 108. In some embodiments, the picker 106 may reorient the package 104 from the storage orientation to the loading orientation while transporting the package along axis 232 or may reorient the package 104 after transporting the package along axis 232.

In many embodiments, the picker 106 can include one or more attachment components for aiding the gripper in attaching to the package. For example, the picker 106 can include an attachment component positioned at the end of the picker arms 234. The attachment components can be or include a suction cup. The attachment components may be or include, hooks, magnets, an air suction hose, or similar devices for attaching to and picking up packages 104.

The gripper assembly 108 can grip the package 104 being held by the picker 106 and transport the package to a filling station 114 and/or a sealing station 118. The gripper assembly 108 can be or include two parallel bars that can be brought together and moved apart to grip or release the package 104. The gripper assembly 108 can be drivingly mounted to the support frame 124 and can move along axis 232. However, the gripper assembly 108 may move along an axis offset from axis 232. The gripper assembly 108 can be moved by one or more actuators 239.

The gripper assembly 108 can move between a first position and a second position. In the first position, the gripper assembly 108 can grip the package 104 while the package is being held by the picker in the loading orientation. In the second position, the gripper assembly 108 can position the package 104 at the loading station 114 and/or the sealing station. For example, the gripper assembly 108 can move to the first position to grip the package 104 being held by the picker 106 and move to the second position to transport the package from the picker to the loading station.

In many embodiments, the gripper assembly 108 can include a first gripper 109 and a second gripper 110. The first gripper 109 can grip the package 104 held by the picker 106 and transport the package from the picker to the filling station 114. The second gripper 110 can grip the package 104 at the filling station and transport the package 104 from the filling station 114 to the sealing station 118. In some embodiments, the second gripper 110 can grip the package 104 at the sealing station and transport the package to an output station or similar component for transportation away from the item packaging system 100.

The loading station 114 can support the package 104 while items 102 are being loaded into the package. The loading station 114 can include a platform 240 for supporting the bottom of the package 104. The platform 240 can be or include rollers, powered rollers, or similar components to aid in transporting the package 140 from the loading station 114 to a downstream location (such as the sealing station 118).

In some embodiments, the platform 240 can move up or down to accommodate different sized packages 104. For example, a first package 104A with a first height can be transported to the loading station 114 and the platform 240 can be raised or lowered to support the bottom of the package 104A. A second package 104B with a second height can be transported to the loading station 114 and the platform can be raised or lowered to the support the bottom of the package 104B. The platform 240 can be moved up or down by one or more actuators 244.

In many embodiments, the loading station 114 can include one or more loading components 116 for aiding in the insertion of items 102 in the package 104. For the example, the loading components 116 can be or include a separator for separating the sides of the package 104 to allow for items 102 to be inserted in the package. Additionally or alternatively, the loading components 116 can be or include an air jet for directing air into an interior volume of the package 104. For example, the air jet can direct air into the interior volume of the package 104 through an opening created by the separators separating the sides of the package. The components can be attached to the support frame 124 and positioned to accommodate any size of package 104.

In further embodiments, the loading station 114 can include a label applicator. The label application can apply a marking and/or label to the package 104. The label applicator can apply the label prior to the items 102 being positioned in the package 104. However, the label may be applied after the items 102 have been positioned in the package 104. The label application may apply the label via directed air. For example, directing a jet of air to apply the label to the package 104. The label applicator may additionally or alternatively apply the label with a laser, glue, staples, or a similar label application device.

The sealing station 118 can support the package 104 while the items 102 are contained within the interior volume of the package. The sealing station 118 can include one or more sealing devices 120 to aid in sealing the package 204. The sealing station 118 can include a platform 242 for supporting the bottom of the package 104. The platform 242 can be the same or similar to the platform 240 (e.g., including driven rollers or rollers). Similar to platform 240, platform 242 can be raised or lowered to support packages 104 with various heights.

In some embodiments, the item packaging system 100 can include one or more displays 236 for providing information to a user. For example, the displays 236 can display information about what items 102 should be loaded into the package 104 at the loading station 114. The displays may additionally or alternatively display information about the packages 104 in the package containers 112 or where the item packaging system 100 should be moved in the warehouse environment. The items 102 may be loaded using an apparatus that is or can be similar to the machines and systems described in application Ser. No. 16/703,735, filed on Dec. 4, 2019, entitled "AUTOMATIC TRAY DISPENSING," the entire contents of which is hereby incorporated by reference as if fully set forth herein.

Figure 3:
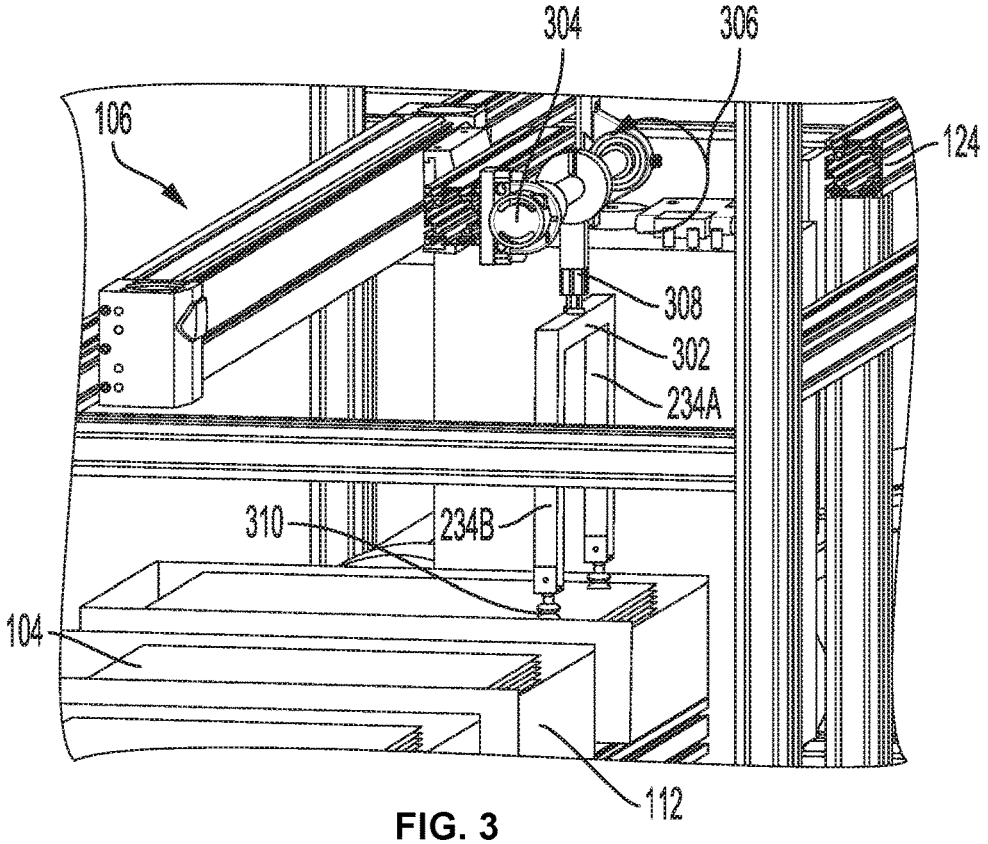
FIG. 3 illustrates an example picker that can be included in particular embodiments of the item packaging system of FIG. 2.

Turning now to FIG. 3, a particular example of the picker 106 is shown. The picker 106 can attach to and pick up the package 104. The picker 106 can attach to the package 104 when the package is in the storage orientation. Additionally or alternatively, the package 104 can be positioned in the package container 112. The picker 106 can include a first arm 234A and a second arm 234B. The arms 234A, 234B can be attached to a shared base bar 302. For example, the first arm 234A can extend from one end of the base bar 302 and the second arm 234B can extend from the opposing end of the base bar. The picker 106 can be or include metal or similar material for with enough strength to attach to and manipulate the package 104.

In many embodiments, the picker 106 can be drivingly connected with a motor 304. The motor 304 can rotate the picker 106 between a picking orientation and a transport orientation. The motor 304 can be attached to a moveable portion of the support frame 124 and move with the picker 106 as it moves along axis 232. The motor 304 can be or include a rotational motor, a stepper motor, or a similar motor capable of rotating the picker 106 and the package 104. In the picking orientation, the arms 234A, 234B can be oriented with the ends opposite the base bar 302 facing downward towards the packages 104. In the transport orientation, the arms 234A, 234B can be oriented with the ends facing away from the packages 104 (e.g., with the arms 234A, 234B generally parallel with the ground). The picker 106 can rotate from the picking orientation to the transport orientation in direction 306.

In further embodiments, the picker 106 can include an actuator 308. The actuator 308 can be positioned between the support frame 124 and the base bar 302 and extend the arms 234A, 234B away from the base bar. For example, the actuator 308 can extend the arms 234A, 234B when the picker 106 is in the picking orientation. Additionally or alternatively, an actuator 308 may be positioned between arm 234A and the base bar and/or arm 234B and the base bar. For example, each of the arms can include an actuator and can be actuated together (e.g. the two actuators 308 actuate at the same time) or actuated separately (e.g., the two actuators actuate the arms 234A, 234B one at a time). The actuator 308 can be rotated with the picker 106 when the gripper is rotated between the picking orientation and the transport orientation. In an illustrative example, the picker 106 is rotated to the picking orientation with the ends of arms 234A and 234B facing toward package 104. The actuator 308 can extend the arms 234A and 234B away from the base bar 302 until the arms contact the package 104. The arms 234A and 234B can attach to the package 104 and the picker 106 can be rotated from the picking orientation with the package. The actuator 308 can be or include a motor, a stepper motor, or a similar device for moving the position of the arms.

In some embodiments, the picker 106 can include picking components 310. The picking components 310 can aid in attaching the picker 106 to the package 104. The picking components 310 can be positioned on the end of one or more arms 234. For example, a picking component 310 can be positioned at the end of the first arm 234 for attaching to the package 104. The picking components 310 can be or include a suction cup, a hook, magnets, a vacuum hose, opposing hooks and loops, or components suitable for attaching to and holding the package 104.

Figure 4:
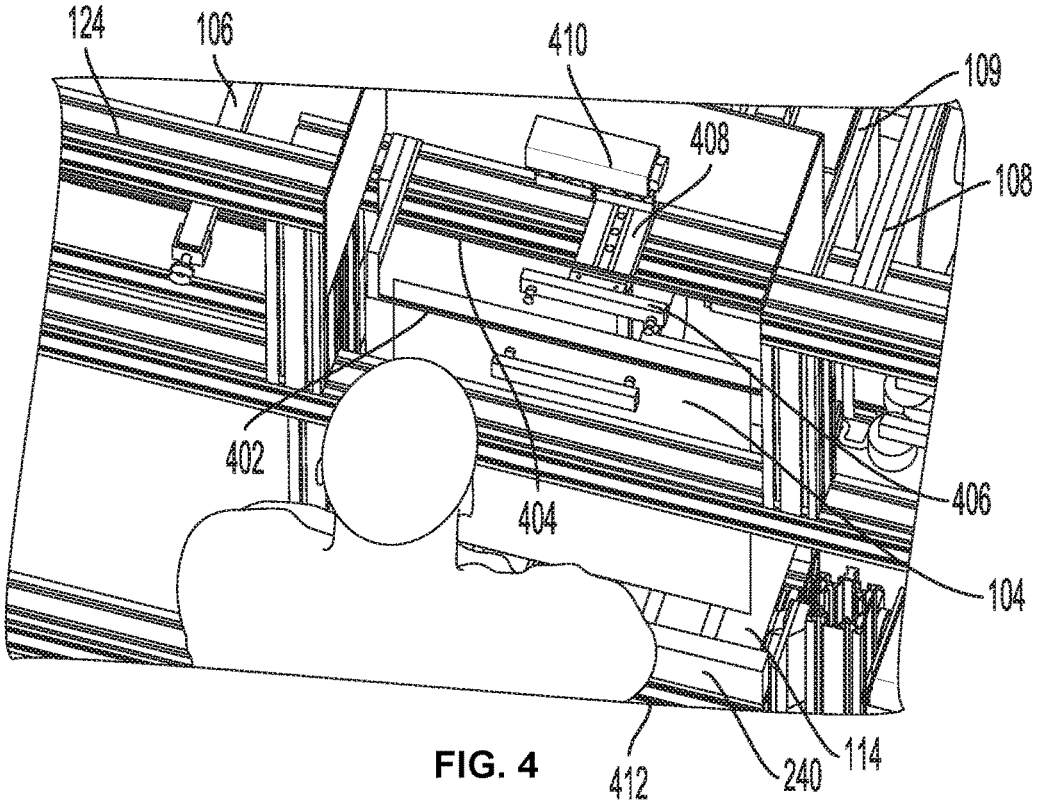
FIG. 4 illustrates an example gripper that can be included in particular embodiments of the item packaging system of FIG. 2.

Turning to FIG. 4, FIG. 4 illustrates an example of the loading station 114 and gripper assembly 108. The gripper assembly 108 can grip the package 104 being held by the picker 106 in the loading orientation. The gripper assembly 108 can be holding the package 104 while the picker 106 disengages. The gripper assembly 108 can transport the package 104 to the loading station 114 for placing one or more items 102 in the package. The example loading station 114 can receive the package 104 on the platform 240 that can be positioned to contact and support the bottom of the package 104. The platform 240 can be positioned by raising or lowering the platform with one or more actuators 412.

The gripper assembly 108 can include a first gripper 109 with a front bracing bar 402 and a back bracing bar 404. The bracing bars 402, 404 can be attached with one or more actuators to move the bracing bars. For example, the actuators can move the front bracing bar 402 and/or the back bracing bar 404 toward the package 104 for gripping the package. As an illustrative example, the front bracing bar 402 and back bracing bar 404 are actuated to move towards one another and grip the package 104 between the bracing bars. The front bracing bar 402 and the back bracing bar 404 can be actuated to move away from one another to release the package 104. For example, the bracing bars 402, 404 can move away from one another to release the package 104 when the package has been transported to the loading station 114. In various embodiments, the bracing bars 402, 404 can wait to move away from one another to release the package 104 until the package is otherwise secured or grasped at the loading station 114.

In some embodiments, the front bracing bar 402 and the back bracing bar 404 can be actuated to move apart from one another. The bracing bars 402, 404 can move apart to a distance allowing for unobstructed access to an opening in the package 104. For example, the bracing bars 402, 404 can move away from one another to a distance that allows unobstructed access to the top of the package 104. Items 102 can be positioned in the interior volume of the package 104 by transporting the items between the bracing bars 402, 404. As an illustrative example, the bracing bars 402, 404 can be actuated apart to allow unobstructed access to an opening of the package 104. A user can move items 102 between the bracing bars 402, 404 and through the opening in the package 104 for positioning of the items 102 in the interior volume of the package 104. The user can move away from the package 104 and the bracing bars 402, 404 can be actuated together to grip the package.

In many embodiments, the loading station 114 can include one or more separators 406 to aid in separating and preparing the package 104 for receiving items 102. The separators 406 can be an example of loading components 116, however, additional or alternative components may be used. The separators 406 can attach to the exterior of the package 104 and pull one or more sides of the package to open the package for receiving items 102. The separators 406 can be or include suction cups, magnets, hooks, a vacuum hose, hook and loop attachments, or similar components for attaching to a package 104.

In some embodiments, the separators 406 can be mounted to one or more actuators 408 408 for actuation. The actuators 408 can be mounted to the support frame 124 to actuate the separators 406 toward or away from the package. In an illustrative example, a pair of opposing separators 406 are attached to one or more actuators 408, with the package 104 positioned between the separators. The actuators 408 actuate one or both of the separators 406 towards the package 104 and attach to opposing sides of the package. The actuators 408 actuate one or both of the separators 406 away from one another to pull apart the opposing sides of the package 104. The opposing sides of the package 104 can be pulled apart until one or more sides of the package has an opening large enough to receive one or more items 102. The actuators 408 can be or include a motor, a stepper motor, or a similar component for moving the separators 406.

In further embodiments, the loading station 114 can include an air jet 410 for aiding in the preparing of the package 104 for receiving items 102. The air jet 410 can be mounted to the support frame 124 and positioned above the package 104. The air jet 410 can direct air towards an opening in the package 104. For example, the air jet 410 can direct air through the open side of the package 104 after the separators 406 have pulled the opposing sides of the package apart. The air jet 410 can be or include a compressed air nozzle, or similar components for directing air. The air jet 410 may be used in addition to or as an alternative to the separators 406.

Figure 5:
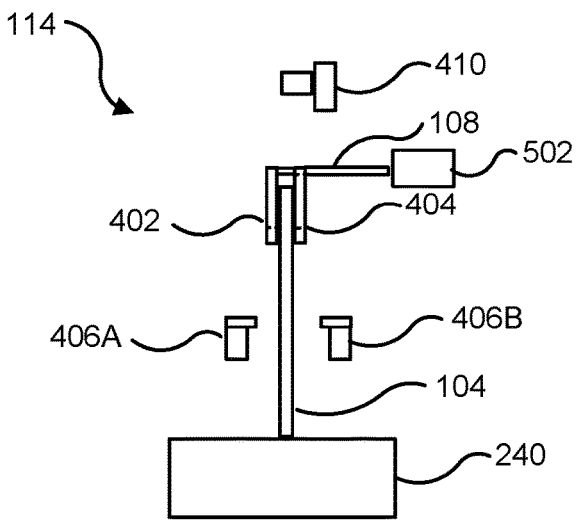
FIGS. 5 through 8 illustrate a simplified example of a process for depositing items into an item package that can be used with particular embodiments of the item packaging system of FIG. 2.

FIGS. 5 through 8 illustrate a process of preparing a package 104 for receiving one or more items 102 using the gripper assembly 108 and the components of the loading station 114, however, additional and/or alternative components may be used. FIG. 5 (e.g., which may correspond to a view along a direction parallel to the axis 232 from FIG. 2) illustrates the package 104 positioned at loading station 114. The package 104 can be transported to the loading station 114 by the gripper assembly 108. The front brace bar 402 and the back brace bar 404 of the gripper assembly 108 can be actuated toward one another to grip the package 104 (e.g., to arrive at the configuration shown in FIG. 5). For example, the front brace bar 402 and the back brace bar 404 can be actuated toward one another to grip the package 104 near one end (e.g., an upper end) of the package. The front brace bar 402 and/or the back brace bar 404 can be actuated by one or more actuators 502. The package 104 can be positioned at the platform 240 with the package in the loading orientation and can be in a folded and/or compressed state (e.g., the same or a similar compressed state the package is in when it is being stored in the storage orientation). The package 104 can be positioned on platform 240 and aligned beneath an air jet 410. Platform 240 can be raised or lowered to contact and support the bottom of the package 104. A pair of opposing separators 406A and 406B can be positioned adjacent to the package 104, with the package positioned between the pair of opposing separators. The separators 406A and 406B can be positioned at a distance away from the package 104 to allow the gripper assembly 108 to position the package at platform 240.

Figure 6:
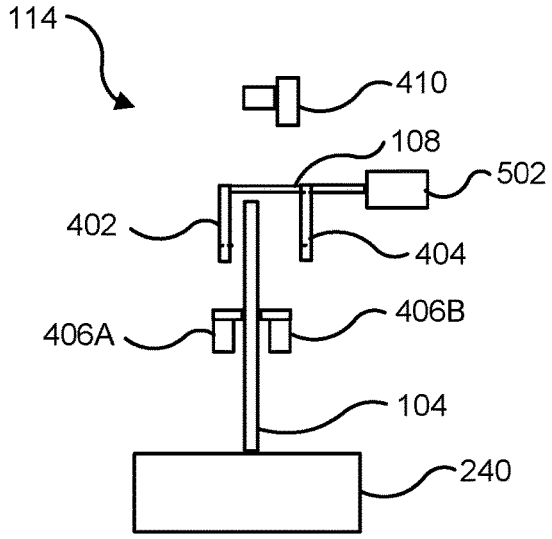

Referring to FIG. 6, the pair of separators 406A and 406B can be actuated toward one another to contact and attach to the package 104. The pair of separators 406A and 406B can attach to and support the package 104, for example, such that the gripper assembly 108 can release the package once the package is supported by the separators and/or platform 240. However, in some examples, the separators 406A and 406B may attach to the package 104 after or simultaneously with the release by the gripper assembly 108 (e.g., based on the platform 240 supporting the package 104 while the package 104 switches between being engaged by the gripper assembly and being engaged by the separators). The front brace bar 402 and the back brace bar 404 of the gripper assembly 108 can be moved away from one another to release the package 104. The pair of separators 406A and 406B can be moved away from one another to pull apart opposing sides of the package 104 (e.g., toward the arrangement shown in FIG. 7).

Figure 7:
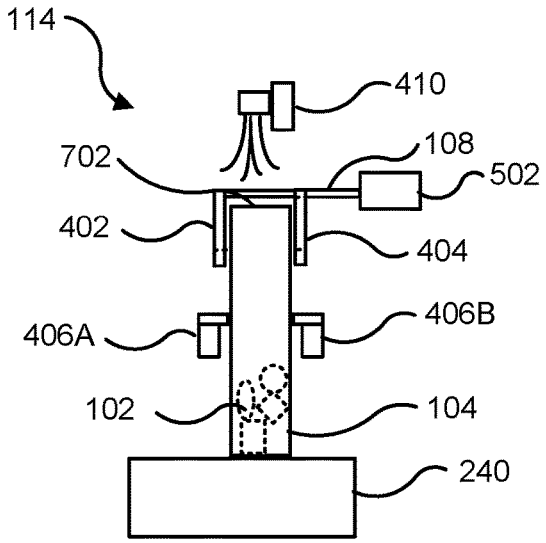

Referring to FIG. 7, the pair of separators 406A and 406B can pull apart the opposing sides of the package 104. However, a single separator 406 or more than two separators may be used to pull apart the opposing sides of the package 104. Pulling apart the opposing sides of the package 104 can expand the package to have a larger interior volume than when the package was in the create an opening 702 in one or more of the sides of the package 104 (e.g., through a top side in the orientation depicted). An air jet 410 can direct air through the opening 702 to aid in opening the package. For example, the air jet 410 can direct air through the opening 710 to reach the bottom of the package 104, e.g., which may separate sides of the package 104 that may have been incompletely opened or separated by action of the separators 406A and 406B alone. The opening 710 can be sized and shaped for receiving one or more items 102. The items 102 can be inserted through the opening 710 and positioned at the bottom of the package 104, e.g., in a stack or pile that may extend upward from the bottom of the package. The platform 240 can support the items 102 positioned in the package 104, e.g., which may reduce a risk of a bottom of the package rupturing if items are dropped into the package.

Figure 8:
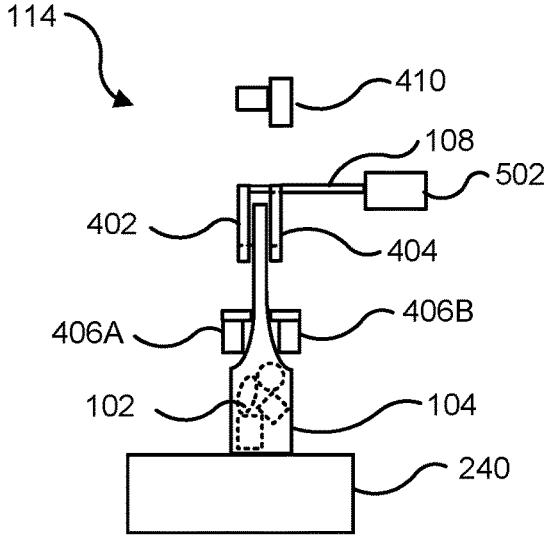

Referring to FIG. 8, the front brace bar 402 and the back brace bar 404 can be actuated toward one another to grip the package 104. The front brace bar 402 and the back brace bar 404 can grip the package 104 for transportation from the loading station 114 to the sealing station 118. The front brace bar 402 and the back brace bar 404 can grip the package 104 with a force greater than the force used to grip the empty package, for example, to account for added weight of the package from items 102 contained therein. The package 104 can be gripped near the top of the package. The closing actuation of the front brace bar 402 and the back brace bar 404 may be sufficient to disengage the separators 406A and 406B from the package 104, and/or the separators may be actuated before, during, or after the actuation of the front brace bar and the back brace bar to facilitate both release of the package by the separators and also movement of the filled package by the gripper assembly 108. In some embodiments, the separators 406A and 406B can be actuated toward one another in conjunction with the closing actuation of the front brace bar 402 and back brace bar 404. For example, the separators 406A and 406B can move to a position at or near the position where the separators engaged with the package 104. The separators 406A and 406B can disengage with the package 104 and can be actuated apart from one another to receive another package. However, the separators 406A and 406B may remain at or near the engagement position to receive another package 104.

Figure 9:
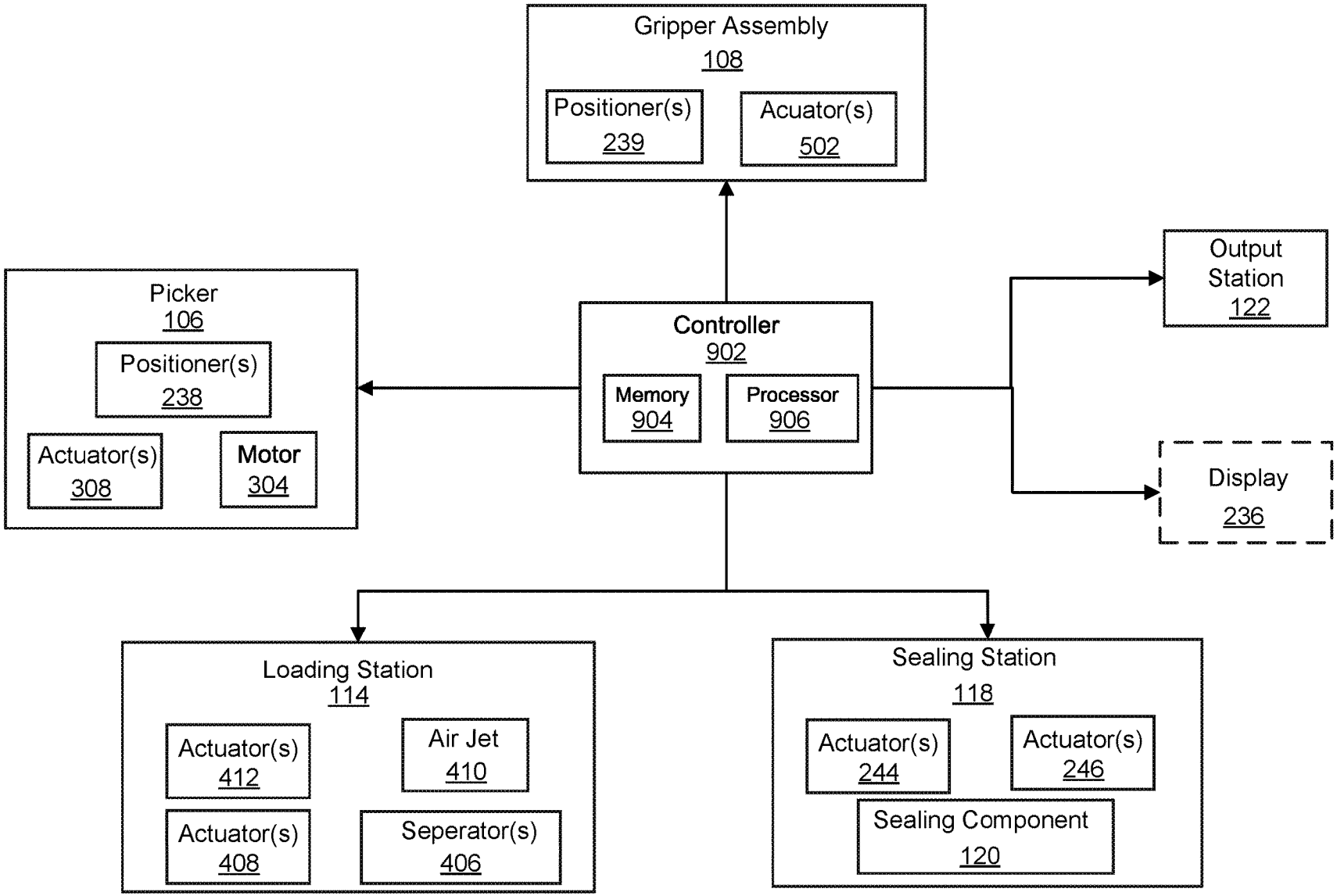
FIG. 9 is a simplified schematic diagram illustrating control aspects of the material handling apparatus of FIG. 1.

FIG. 9 is a simplified schematic diagram illustrating control aspects of the item packaging system 100 of FIG. 1. A controller 902 can communicate information and/or instructions associated with the item packaging system 100. The controller 902 can be in communication with the picker 106, the gripper assembly 108, the loading station 114, the sealing station 118, one or more sensors 920, the output station 122, the display 236, and/or respective components associated with such elements, such as graphically included within each element in FIG. 9. The controller 902 can communicate via a wired or wireless connection (e.g., Bluetooth). The controller 902 can include memory 904 and a processor 906. The memory 904 and the processor 906 can be included in a single structure. However, the memory 904 and processor 906 may be part of a system of multiple interconnected devices.

The memory 904 can include any type of memory device that retains stored information when powered off. The memory 904 can be or include electrically erasable and programmable read-only memory ("EEPROM"), flash memory, or any other type of non-volatile memory. In some examples, at least part of the memory 904 can include a medium from which the processor 906 can read instructions. A non-transitory computer-readable medium can include electronic, optical, magnetic, or other storage devices capable of providing the processor 906 with computer-readable instructions or other program code. Non-limiting examples of a computer-readable medium include (but are not limited to) magnetic disk(s), memory chip(s), ROM, random-access memory ("RAM"), an ASIC, a configured processor, optical storage, or any other medium from which a computer processor can read instructions. The instructions can include processor-specific instructions generated by a compiler or an interpreter from code written in any suitable computer-programming language, including, for example, C, C++, C#, etc.

The processor 906 can execute instructions stored in the memory 904 to perform operations, for example, determining an item status based on item data. The processor 906 can include one processing device or multiple processing devices. Non-limiting examples of the processor 906 include a Field-Programmable Gate Array ("FPGA"), an application-specific integrated circuit ("ASIC"), a microprocessor, etc.

The controller 902 can communicate with and send instructions to the picker 106, the gripper assembly 108, the loading station 114, the sealing station 118, the one or more sensors 920, the output station 122, the display 236, and/or respectively associated elements. The controller 902 can send operating instructions to one or more of the components described herein to orient a package 104, prepare and position the package for receiving items 102, seal the package, and/or output the package.

Figure 10:
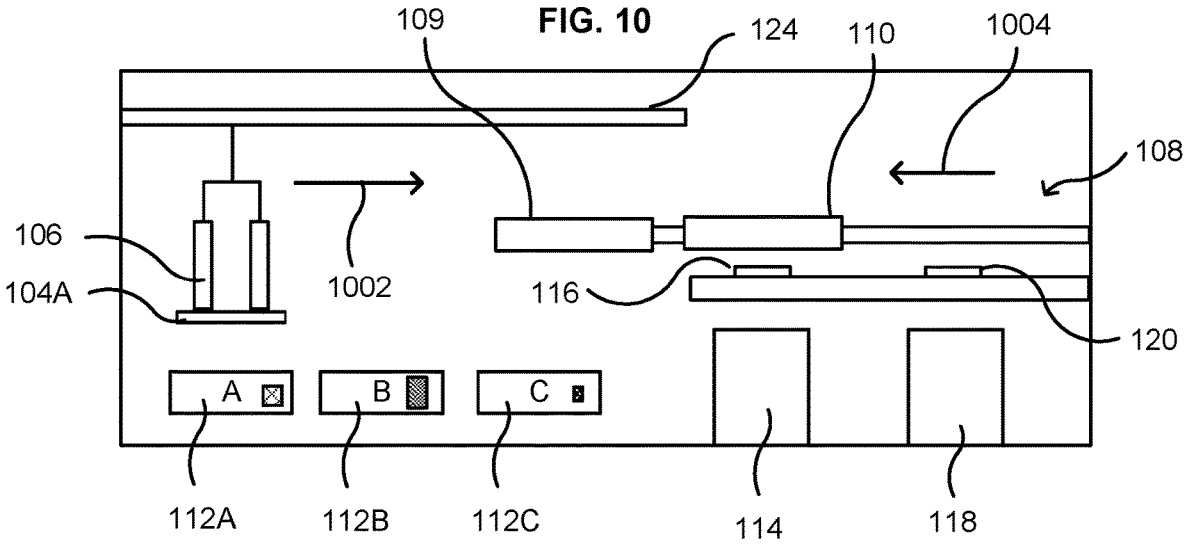
FIGS. 10 through 14 illustrate a simplified example of a process for packaging items that can be used with particular embodiments of the item packaging system of FIG. 1.

Turning to FIGS. 10 through 14 a simplified example of a process of packaging items 102 in a package 104 is shown. The simplified process is described referencing the components described in FIG. 1, however, any of the components described herein can be used with the process. In FIG. 10, a package 104A can be picked from a container 112A by the picker 106. The package 104A can be in a storage orientation in the container 112A and include a first set of dimensions. The picker 106 can be in the picking orientation and positioned above the container 112A (e.g., based on operation of the positioner 238). The picker 106 can be moved in a downward direction (e.g., via the actuator 308) toward the package 104A until the picker attaches to the package. The picker 106 can rotate to the transport orientation (e.g., via the motor 304), rotating the package 104A to the loading orientation. The picker 106 can transport the package 104A along direction 1002 (e.g., based on operation of the positioner 238) until the picker 106 is adjacent to the gripper assembly 108. In some embodiments, the picker 106 can transport the package 104A in the picking orientation along direction 1002 prior to rotating the package to the loading orientation.

The gripper assembly 108 can be positioned in a first position for receiving the package 104A from the picker. In the first position, the first gripper 109 can overlap with the picker 106 to receive the package 104 from the picker. The gripper assembly 108 can be movable from and/or to the first position. For example, the gripper assembly 108 can be movable from the first position to a second position, and in various circumstances, the gripper assembly 108 may reach the first position within a cycle by moving back from the second position. As an illustrative example, the gripper assembly 108 can be positioned in a second position above the loading and/or sealing stations 114 and 118 and travel along direction 1004 to the first position.

Figure 11:
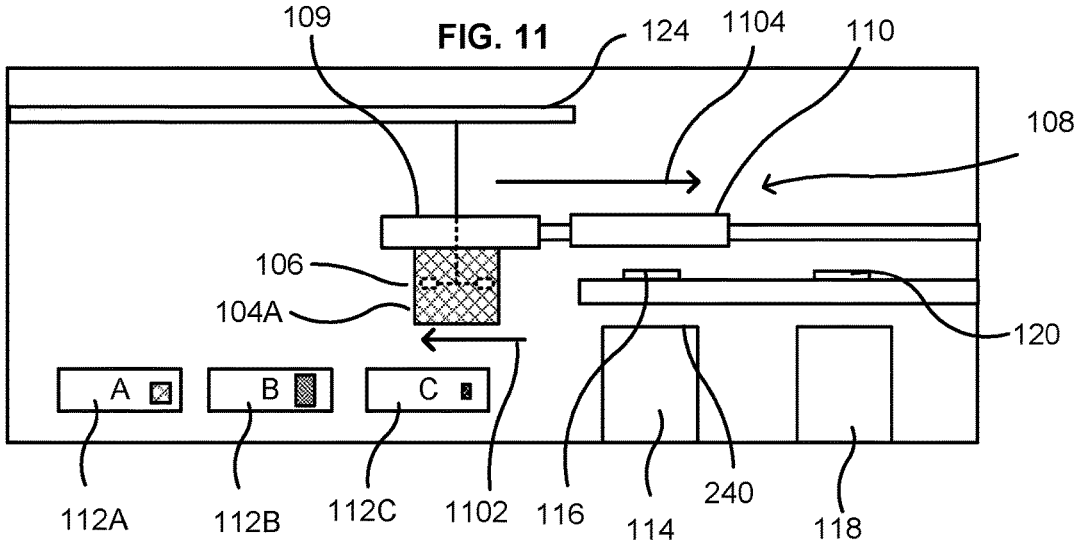

In FIG. 11, the gripper assembly 108 can grip the package 104A in the loading orientation. The gripper assembly 108 can be positioned at the first position and grip the package 104A with a first gripper 109 (e.g., via actuator 502). The gripper assembly 108 can grip the package 104A and the picker 106 can detach from the package. The picker 106 can move along direction 1102 via the positioner 238 to a position above a storage container 112 (e.g., storage container 112B). The gripper assembly 108 can move along direction 1104 to the second position of the gripper assembly (e.g., where the package 104A is positioned at filling station 114). The gripper assembly 108 can position the package 104A aligned with at least a portion of the platform 240. Platform 240 can be raised or lowered to contact the bottom of package 104A and support the package. In many embodiments, the package 104A has a flat bottom for engaging with a flat surface of platform 240.

Figure 12:
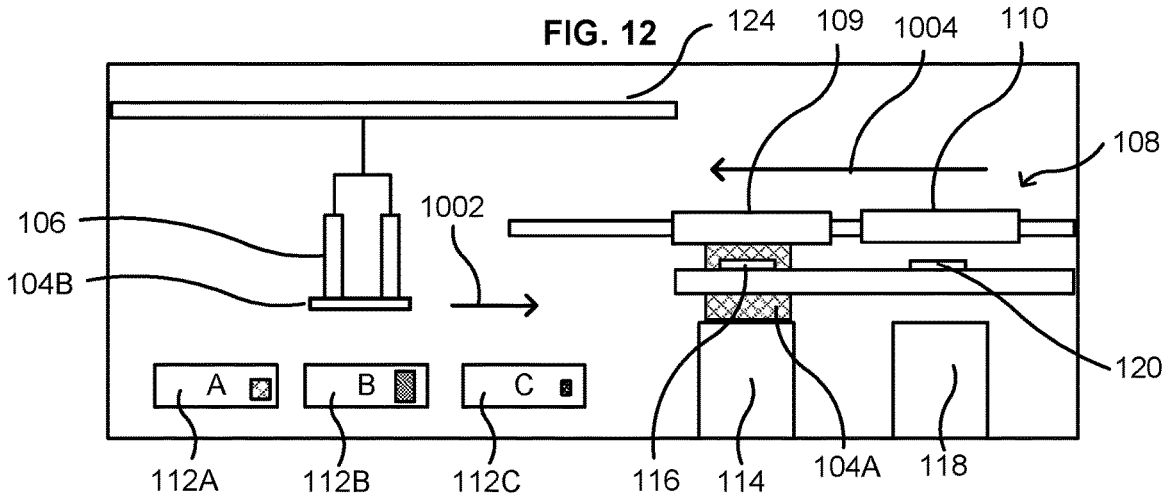

In FIG. 12, the gripper assembly can position the package 104A at the filling station 114. The loading components 116 can prepare the package 104A for receiving one or more items 102. For example, the package 104A can be prepared for receiving the items 102 using the process described in FIGS. 5 through 8 (e.g., separating the package, directing air into the package, filling the package, and re-gripping the package). However, the package 104A may be prepared using additional and/or alternative processes. The gripper assembly 108 can release the package 104A positioned at the filling station and travel along direction 1004 to be positioned at the first position. The gripper assembly 108 can travel along direction 1004 to the first position for receiving packages 104.

The picker 106 can be positioned above container 112B and pick a package 104B in the storage orientation. The package 104B can be picked by the picker 106 using the process described in reference to FIG. 10. The package 104B can include second dimensions. The second dimensions can differ from the first dimensions of package 104A. For example, the package 104A may have a smaller height dimension than the package 104B. The picker 106 can transport the package 104B along direction 1002 to position the package adjacent to the gripper assembly 108 for gripping. For example, the picker 106 can position the package 104B for gripping by the first gripper 109.

Figure 13:
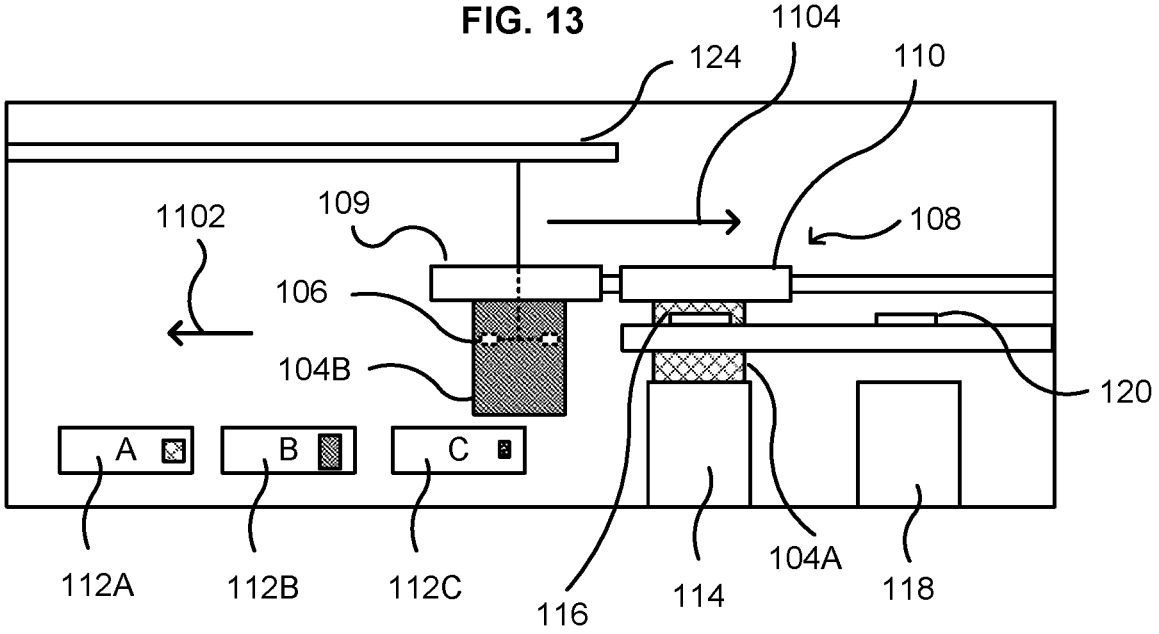

In FIG. 13, the gripper assembly 108 can grip package 104B held by the picker 106 and 104A positioned at the filling station 114. For example, the first gripper 109 can grip package 104B and the second gripper 110 can grip package 104A. The first gripper 109 and the second gripper 110 can grip the packages 104A and 104B during the same motion. However, the grippers 109, 110 may grip the packages 104A, 104B independently. For example, the first gripper 109 may grip package 104B prior to the second gripper 110 gripping package 104A. The picker 106 can disengage from the package 104B and travel in direction 1102 to a position above a storage container 112. For example, the picker may travel to a position above storage container 112C for picking a package 112C.

The gripper assembly 108 can transport the packages 104A, 104B along direction 1104. For example, the gripper assembly 108 can move both packages 104A, 104B with the same motion (e.g., simultaneously). Movement of the gripper assembly 108 may move the packages 104A, 104B to the position shown in FIG. 14, for example.

Figure 14:
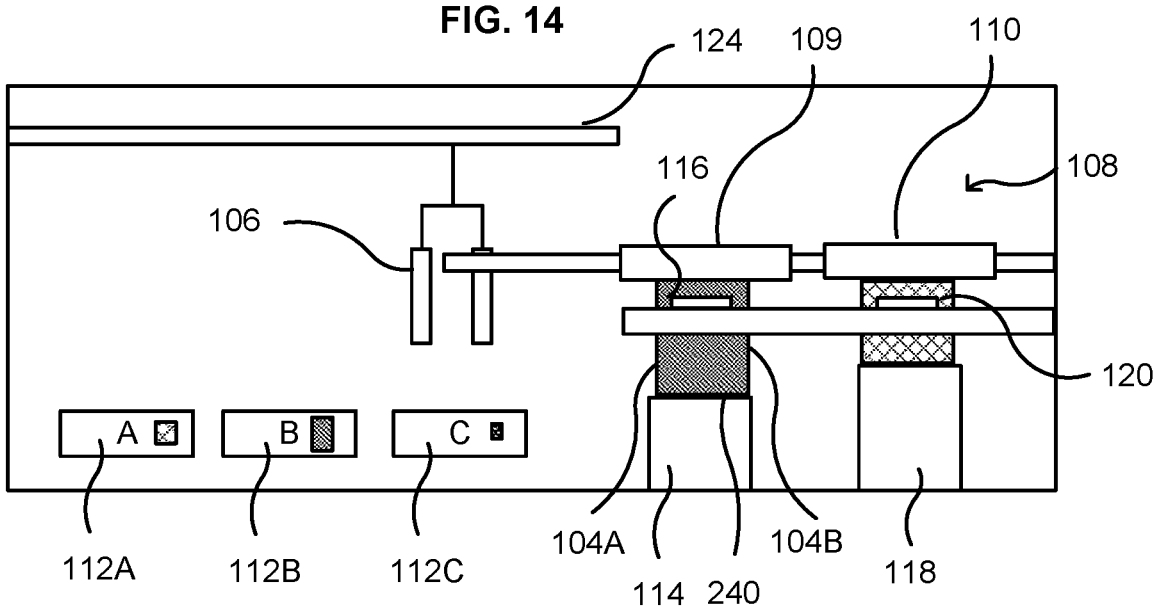

Referring to FIG. 14, the gripper assembly 108 can position package 104A at the sealing station 118 and position package 104B at filling station 114. Package 104B can be prepared to receive items 102 at filling station 114. Package 104B can be prepared using the same or a similar process that was used to prepare package 104A for receiving items 102. However, a different process may be used to prepare package 104B to receive items 102. The height of platform 240 can be changed to engage with the package 104B. For example, if package 104B has a greater height than package 104A the platform 240 can be lowered.

Package 104A can be positioned at sealing station 118. The package 104A can be positioned at sealing station 118 by the second gripper 110. The sealing station 118 can include sealing components 120 for sealing the package 104A. For example, the sealing components 120 may seal the package 104A by gluing a portion of the package.

In many embodiments, the sealed package 104A can be removed from the sealing station 118 for further processing. For example, the second gripper 110 (e.g., upon completion of the sealing operation by the sealing components 120) may actuate to release the package 104A in a sealed state and in a manner that allows the package 104A to be received by the output station 122, which can transport the sealed package 104A for processing.

Figure 15:
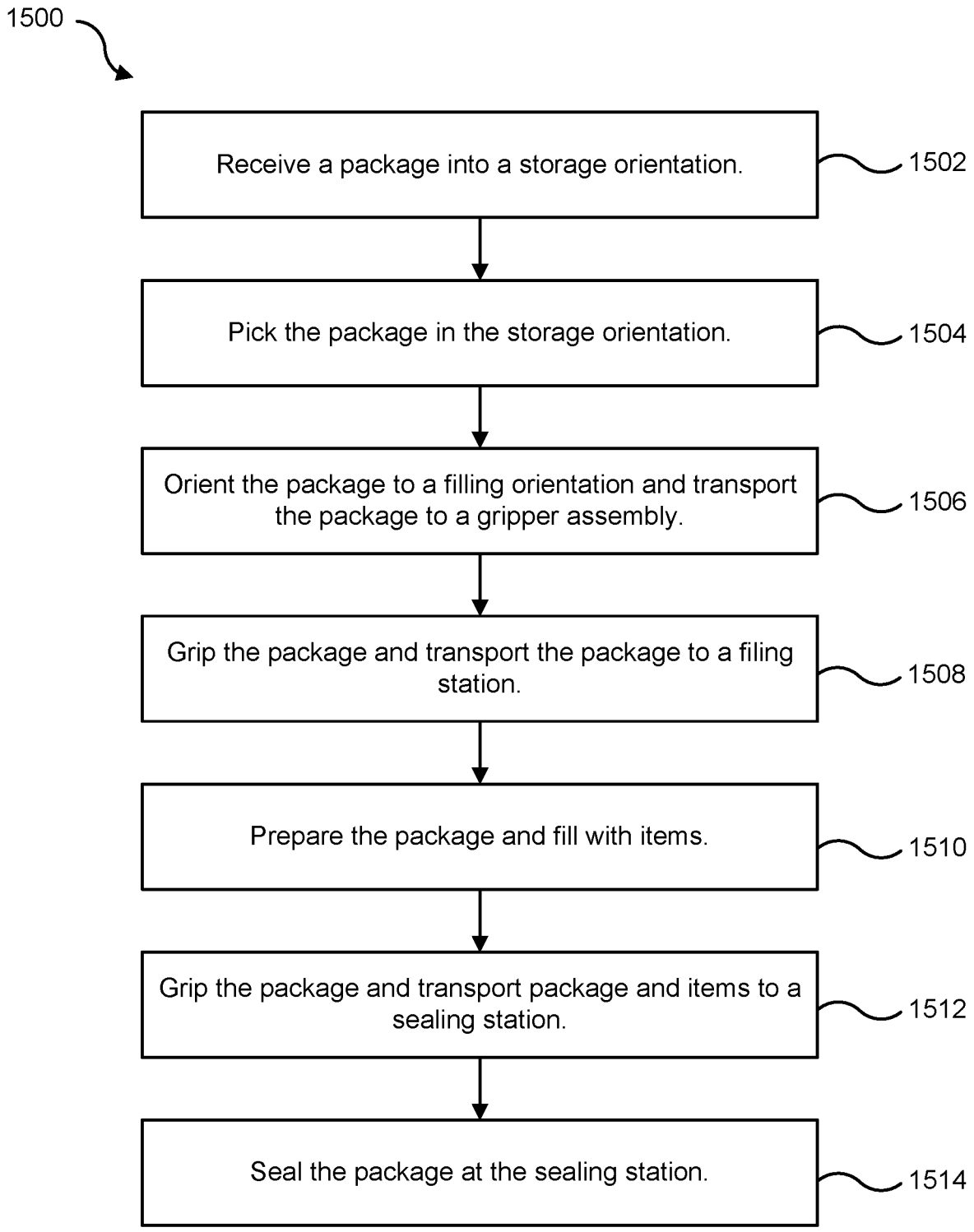
FIG. 15 is a flowchart illustrating a process for packaging items for use with the item packaging system for use with the inventory system of FIG. 1.

Turning to FIG. 15, FIG. 15 shows a flow chart representing an example process 1500 for using an item packaging system to package one or more items. The item can be, for example, item 102, and the package can be, for example, package 104. The process 1500 can be practiced with item packaging system 100 or any suitable devices and approaches, such as those described herein. Some or all of the process 1500 (or any other processes described herein, or variations, and/or combinations thereof) may be performed under the control of one or more computer systems or controllers configured with executable instructions and may be implemented as code (e.g., executable instructions, one or more computer programs, or one or more applications) executing collectively on one or more processors, by hardware or combinations thereof. The code may be stored on a computer-readable storage medium, for example, in the form of a computer program comprising a plurality of instructions executable by one or more processors.

The computer-readable storage medium may be non-transitory. Moreover, unless indicated otherwise, acts shown in the processes are not necessarily performed in the order shown, and/or some acts can be omitted in embodiments.

The process 1500 at 1502 can include receiving a package 104 in a storage orientation. For example, this may correspond to the package 104 being received in a storage container 112. The package 104 can be received from a package feeder 230 in the storage orientation. The package feeder 230 can feed various types of packages 104 to one or more item containers 112. For example, the package feeder 230 can feed packages 104 with different dimensions to different storage containers 112.

The process 1500 at 1504 can include picking the package 104 from the storage orientation. For example, this may correspond to the package 104 being picked from the storage container 112. The package 104 can be picked by a picker 106. The picker 106 can be positioned above the container 112 and oriented in a picking orientation. The picker 106 can be operated to contact the package 104 and lift the package out of the container 112.

The process 1500 at 1506 can include orienting the package 104 to a filling orientation and transporting the package to a gripper assembly 108. The package 104 can be oriented to the filling orientation by rotating the picker 106. For example, the picker 106 can be rotated from the picking orientation to a transport orientation, orienting the package 104 to the filling orientation. The picker 106 can transport the package 104 to a position adjacent to the gripper assembly 108. The picker 106 can transport the package 104 prior to rotating or may transport the package after rotating. The picker 106 may additionally or alternatively rotate the package 104 while transporting the package.

The process 1500 at 1508 can include gripping the package 104 and transporting the package to a filling station 114. The package 104 can be gripped by the gripping assembly 108. For example, the package 104 can be gripped by a first gripper 109. The gripper assembly 108 can transport the package 104 and position the package 104 at the filling station 114 for receiving one or more items 102.

The process 1500 at 1510 can include preparing the package 104 for receiving one or more items 102. The filling station 114 can prepare the package 104 for filling, for example, by separating parts of the package to form an opening in the package for receiving the items 102. The package 104 can be prepared using loading components 116, air jet 410, and/or the process described in reference to FIGS. 5 through 8. The items 102 can be positioned in the package 104 after the opening has been formed in the package. The items 102 can be positioned to partially or fully fill the interior volume of the package 104.

The process 1500 at 1512 can include the gripper assembly 108 gripping the package 104 at the filling station and transporting the package and items 102 to a sealing station 118. The gripping assembly 108 can grip the package 104 at the filling station 114 after the items 102 have been positioned in the interior of the package. For example, the second gripper 110 can grip the package 104 at the filling station 114. The gripping assembly 108 can transport the package 104 and items 102 to a sealing station 118 for sealing the package with the items therein.

The process 1500 at 1514 can include sealing the package 104 at the sealing station 118. The package 104 can be sealed by one or more sealing components 120. The package 104 can be sealed using, for example, a glue application. The package 104 may be folded or manipulated prior to sealing. The sealed package 104 may be output from the sealing station for further processing.

The specification and drawings are, accordingly, to be regarded in an illustrative rather than a restrictive sense. It will, however, be evident that various modifications and changes may be made thereunto without departing from the broader spirit and scope of the disclosure as set forth in the claims.

Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the disclosure to the specific form or forms disclosed, but on the contrary, the intention is to cover all modifications, alternative constructions, and equivalents falling within the spirit and scope of the disclosure, as defined in the appended claims.

The use of the terms "a" and "an" and "the" and similar referents in the context of describing the disclosed embodiments (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the disclosure and does not pose a limitation on the scope of the disclosure unless otherwise claimed. No language in the specification should be construed as indicating any non-claimed element as essential to the practice of the disclosure.

Disjunctive language such as the phrase "at least one of X, Y, or Z," unless specifically stated otherwise, is intended to be understood within the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

Preferred embodiments of this disclosure are described herein, including the best mode known to the inventors for carrying out the disclosure. Variations of those preferred embodiments may become apparent to those of ordinary skill in the art upon reading the foregoing description. The inventors expect skilled artisans to employ such variations as appropriate and the inventors intend for the disclosure to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A system, comprising:

a plurality of storage containers mounted to a support frame, each of the plurality of storage containers configured to receive a plurality of bags in a storage orientation;

a picker mounted to the support frame and controllable to pick a bag of the plurality of bags from a storage container of the plurality of storage containers in the storage orientation and reorient the bag to a loading orientation;

a loading station configured to receive the bag of the plurality of bags in the loading orientation, the bag receiving one or more items into an interior volume defined by the bag when the bag is positioned on the loading station;

a sealing station configured to receive the bag containing the one or more items in the interior volume of the bag and seal the one or more items in the interior volume of the bag; and a gripper assembly drivingly mounted to the support frame and comprising a first gripper and a second gripper, the gripper assembly configured to move in opposing directions between:

a first position where (i) the first gripper grips a first bag of the plurality of bags being held in the loading orientation by the picker and (ii) the second gripper grips a second bag of the plurality of bags positioned at the loading station and containing items; and a second position where (i) the first gripper deposits the first bag at the loading station in the loading orientation and (ii) the second gripper deposits the second bag containing the items at the sealing station.

2. The system of claim 1, wherein the loading station comprises one or more suction cups for attaching to and pulling apart opposing sides of the bag.

3. The system of claim 1, wherein the loading station or the sealing station comprises a moveable platform operable to raise or lower and contact and support the bag.

4. The system of claim 1, wherein the bag is a paper bag.

5. The system of claim 1, wherein the loading station comprises an air jet configured to direct air into the interior volume of the bag.

6. The system of claim 1, wherein the plurality of storage containers are configured to receive bags having different dimensions.

7. A system, comprising:

a package feeder configured to deposit a shipping receptacle of a plurality of shipping receptacles in a storage orientation into a storage container;

a picker configurable between a first position for picking the shipping receptacle in the storage orientation from the storage container and a second position for orienting the shipping receptacle in a loading orientation for receiving one or more items; and a gripper assembly comprising a first gripper and a second gripper, the gripper assembly operable to move back and forth between a first position and a second position;

wherein in the first position, (i) the first gripper grips the shipping receptacle in the loading orientation, and (ii) the second gripper grips a second shipping receptacle positioned at a loading station and containing one or more items; and wherein in the second position, (i) the first gripper deposits the shipping receptacle at the loading station for loading items into an interior volume of the shipping receptacle, and (ii) the second gripper deposits the second shipping receptacle containing one or more items at a sealing station for sealing of the second shipping receptacle.

8. The system of claim 7, wherein the picker comprises an actuator for extending a distal portion of the picker relative to a proximal portion of the picker to contact the shipping receptacle when the picker is in the first position.

9. The system of claim 7, wherein the loading station comprises one or more separators for attaching to a side of the shipping receptacle and opening the shipping receptacle to form or expand an opening to receive the one or more items.

10. The system of claim 7, wherein the loading station further comprises an air jet configured for directing air through an opening in the shipping receptacle for expanding the interior volume of the shipping receptacle.

11. The system of claim 7, wherein the loading station comprises a moveable platform operable to move along a vertical axis to contact and support an underside of the shipping receptacle.

12. The system of claim 7, wherein the shipping receptacle is a bag defining an interior volume for receiving the one or more items.

13. The system of claim 7, wherein the picker comprises a suction cup positioned on a distal end of an arm.

14. A method of packaging items, comprising:

receiving a plurality of shipping receptacles in a storage orientation into a storage container coupled with a support frame;

operating a picking assembly coupled with the support frame to reorient a first shipping receptacle of the plurality of shipping receptacles from the storage orientation to a loading orientation for receiving one or more items;

operating a gripper assembly coupled with the support frame and comprising first and second grippers, the gripper assembly operable to use the first gripper to grip the first shipping receptacle held by the picking assembly in the loading orientation and to use the second gripper to grip a second shipping receptacle positioned in a loading station and containing one or more items;

operating the gripper assembly to transfer the first shipping receptacle to the loading station and the second shipping receptacle containing the one or more items to a sealing station;

while operating the gripper assembly, operating the loading station to change a height of the loading station based on a height of the first shipping receptacle and operating the sealing station to change a height of the sealing station based on a height of the second shipping receptacle;

operating the loading station to expand the first shipping receptacle to an expanded state for receiving items into an interior volume of the first shipping receptacle;

operating the sealing station to seal the second shipping receptacle containing the one or more items; and operating the gripper assembly to move to a position for (i) gripping of a third shipping receptacle held by the picking assembly with the first gripper and (ii) gripping of the first shipping receptacle with the second gripper.

15. The method of claim 14, wherein operating the picking assembly to reorient the first shipping receptacle from the storage orientation to the loading orientation comprises at least one of:

rotating the picking assembly relative to the support frame between a position for coupling with the first shipping receptacle in the storage orientation and a second position for orienting the first shipping receptacle in a loading orientation for receiving one or more items; and actuating the picking assembly relative to the support frame to contact and couple with the first shipping receptacle.

16. The method of claim 14, wherein operating the loading station to expand the first shipping receptacle further comprises at least one of:

operating a first separator positioned adjacent a first side of the first shipping receptacle to couple with and expand the first shipping receptacle to the expanded state; and operating an air jet to direct air into the interior volume of the first shipping receptacle when the first shipping receptacle is in the expanded state.

* * * * *